United States Patent [19]

Guarderas et al.

[11] 4,102,268

[45] Jul. 25, 1978

[54] IMPACT PRINTER TYPE CHARACTER

[75] Inventors: Fernando V. Guarderas, Woodland Hills; Luis Leon, Redondo Beach, both of Calif.

[73] Assignee: Dataproducts Corporation, Woodland Hills, Calif.

[21] Appl. No.: 591,538

[22] Filed: Jun. 30, 1975

[51] Int. Cl.[2] ..... B41J 7/70

[52] U.S. Cl. ..... 101/399; 101/93.04; D64/12 R

[58] Field of Search .... 101/93.03, 93.04, 93.21-93.36, 101/110, 111, 397, 398, 399, 1; D64/12 R, 12 A, 12 B, 12 C

[56] References Cited

U.S. PATENT DOCUMENTS

| | | | |
|---|---|---|---|
| 1,270,517 | 6/1918 | Hedman | 101/399 X |
| 2,080,333 | 5/1937 | Pendergast | 101/399 |
| 2,131,289 | 9/1938 | Klein | 101/399 |
| 2,718,849 | 9/1955 | Dresser | 101/399 X |
| 3,207,067 | 9/1965 | Schaller | 101/398 X |
| 3,450,041 | 6/1969 | Gentry et al. | 101/93.04 X |
| 3,739,720 | 6/1973 | Jones et al. | 101/399 X |
| 3,773,160 | 11/1973 | Rava et al. | 101/398 X |

*Primary Examiner*—Edward M. Coven
*Attorney, Agent, or Firm*—Lindenberg, Freilich, Hornbaker, Wasserman, Rosen & Fernandez

[57] ABSTRACT

A type surface useful in an impact printer having type characters thereon particularly configured to print large solid blocks. Each type character is comprised of a plurality of spaced land area portions distributed in an area of the type surface whose periphery conforms to the shape and size of the solid block to be printed. The plurality of land area portions present a lower effective contact area to an impacting hammer than would a solid land area of the same periphery, therefore yielding higher density print. The spaces between the land area portions fill in on the printed character as a consequence of smear attributable to the relative movement between the type surface and ink ribbon.

2 Claims, 8 Drawing Figures

IMPACT PRINTER TYPE CHARACTER

BACKGROUND OF THE INVENTION

This invention relates generally to impact printers and more particularly to improvements in type means for printing large solid blocks.

Impact printers of various designs are very well known in the art and are used extensively as output devices in computer systems. One type of impact printer employs a plurality of aligned individually actuatable hammers mounted opposite to a moving type surface such as a rotating drum or linearly moving belt. The type surface has raised characters formed thereon which move past the faces of the hammers. In the case of a drum, the characters normally move perpendicular to the line of hammers. In the case of a belt, the characters normally move along the line of hammers.

An ink ribbon and the paper to be printed upon pass between the hammers and type surface such that actuation of a hammer causes it to impact against the type surface, thus printing the impacted character on the front side of the paper adjacent the ribbon. After a full line is printed, the paper is stepped for printing a subsequent line.

Regardless of the kind of type surface employed, it will typically carry a full set of alphanumeric characters for movement past each hammer face. Since each hammer normally impacts against all characters with the same force, the density of the printed character will vary inverse to the land area or contact area presented to the hammer face. That is, very large land area characters will print light and very low land area characters will print dark.

Applications have recently arisen which require the printing of vastly different size characters on a document. For example, labels for use on supermarket shelves normally identify the product in standard size type and display the price in very large type. If an impact printer is to be used to print such labels and if the large type is to consist of characters larger than the area of a hammer face, then it is necessary to form the large characters modularly, i.e., by printing standard size characters positioned relative to one another to form the large type characters. Attempts have been made to form such large type characters utilizing standard size characters in the shape of solid blocks of rectangular and triangular configuration. One of the significant problems, however, encountered with this approach is that the high land area constituted by such a solid block results in low density (light, grey) printing. This, of course, may be unacceptable in many applications; particularly where the label is being used for display purposes, as in the aforementioned supermarket application.

SUMMARY OF THE INVENTION

The present invention is directed to an improved type surface for use in impact printers for printing high density solid blocks.

In accordance with the invention, the land area of a character on the type surface is segmented, i.e., configured of spaced land area portions extending across the character dimensions perpendicular to the direction of the type surface movement. Use of a segmented, rather than a solid land area, reduces the effective land area impacted by the hammer face thereby increasing the density of printing. Moreover, by orienting the land area portions across the character dimension as aforementioned, the smear produced as a consequence of the relative movement between the type surface and the ribbon fills in the space between land area portions.

In accordance with a preferred embodiment of the invention, the land area portions comprise elongated strips oriented at substantially 45° relative to the direction of type surface movement so as to allow the wiping action between the type surface and ribbon to clean, e.g. remove lint, etc., from the space between the land area portions.

The novel features of the invention are set forth with particularity in the appended claims. The invention will best be understood from the following description when read in conjunction with the accompanying drawings.

BRIEF DESCRIPTION OF THE FIGURES

FIG. 2(*b*) illustrates a moving belt type surface upon which type characters in accordance with the present invention can be formed;

FIG. 4(*b*) illustrates large type modular characters formed utilizing the solid blocks of FIG. 4(*a*)

DESCRIPTION OF THE PREFERRED EMBODIMENT

Figure 1:
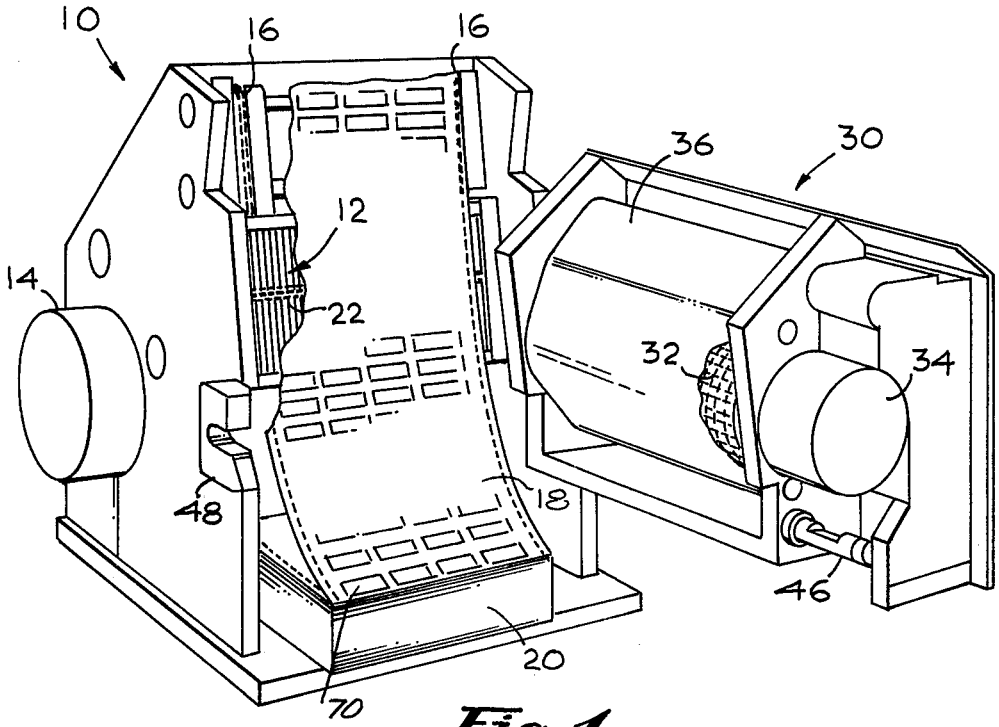
FIG. 1 is a perspective illustration of a typical impact printer in which the teachings of the present invention can be employed.

Attention is now called to FIG. 1 which illustrates a high speed impact printer exemplary of the type generally employed for date processing applications. Briefly, the printer of FIG. 1 is comprised of a first frame 10 supporting a hammer bank assembly 12 and a paper stepping system generally comprised of motor 14 driving tractor chains 16. The chains 16 pull edge perforated paper 18 from a supply stack 20 past the hammer faces 22 of the hammer bank assembly 12. The printer of FIG. 1 also includes a second frame 30 which is hinged with respect to the first frame 10. Frame 30 supports a movable type surface such as a multitract drum 32 which is normally horizontally oriented and rotated about its axis by a motor 34. Means are provided for passing a printing ribbon 36 between the moving type surface drum 32 and the hammmer faces 22.

In the operation of the printer of FIG. 1, the edge perforations of the paper 18 are engaged with the sprockets of chains 16 to thus enable the motor 14 to pull the paper past the hammer faces 22. Normally, the motor 14 steps the paper one line at a time. Printing, of course, can be accomplished only when the frame 30 is pivoted to a closed position relative to the frame 10 and locked thereto, as by cooperating latch portions 46 and 48. In this closed operative position, the hammer faces 22 will be disposed very close to the paper which in turn will be disposed very close to the printing ribbon 36. As the character drum 32 rotates, it cyclically passes different raised characters in front of each hammer face. By actuating a hammer at an appropriate time, the hammer face is propelled against the back side of the paper 18, thus forcing the paper against the ribbon 36 and drum 32 to thus print a character on the front side of the paper.

Figure 2B:
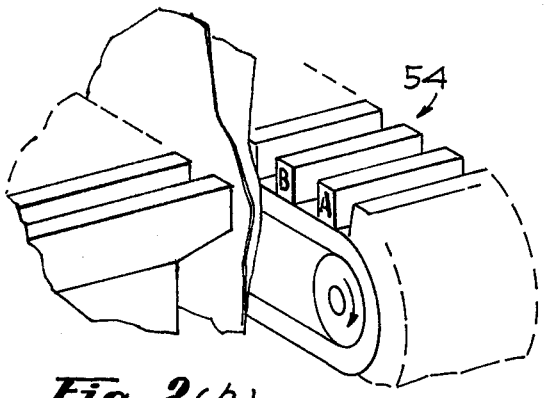
FIG. 2(*a*) schematically illustrates a moving drum type surface upon which type characters in accordance with the present invention can be formed.
Figure 2A:
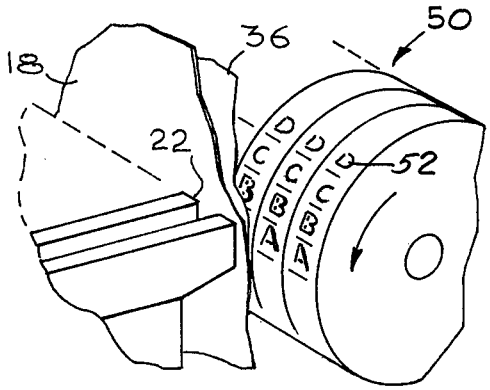

FIG. 2(*a*) illustrates a typical type surface drum 50 in greater detail. Type characters 52 having raised land areas are formed on the surface of the drum 50 and are preferably arranged in rows extending parallel to the drum axis and columns or rings extending around the drum axis. Normally, the drum 50 will have a number of character columns equal to the maximum number of characters to be printed on a line. Typically, the drum will be provided with 132 columns and a hammer bank comprised of the same number of hammers will be mounted adjacent thereto. That is, each hammer in the hammer bank will be dedicated to impacting the drum along a particular one of the character columns. Each character column will normally include a full set of characters to be printed. Thus, a typical type surface drum column will contain 64 different alphanumeric characters. As the drum rotates about its axis, the characters move perpendicularly past the line of hammers. In one full rotation of the drum, a full set of characters will move past each hammer and by selecting the appropriate time to actuate each hammer, any character can be printed in any position along a line in a single drum rotation.

FIG. 2(*b*) schematically illustrates an alternative form of type surface in which the characters are moved along the line of hammers, rather than perpendicularly thereto as in FIG. 2(*a*). The type surface of FIG. 2(*b*) is generally referred to as a chain or belt and has been described in the prior art; see, for example, U.S. Pat. No. 3,845,711.

Figure 3:
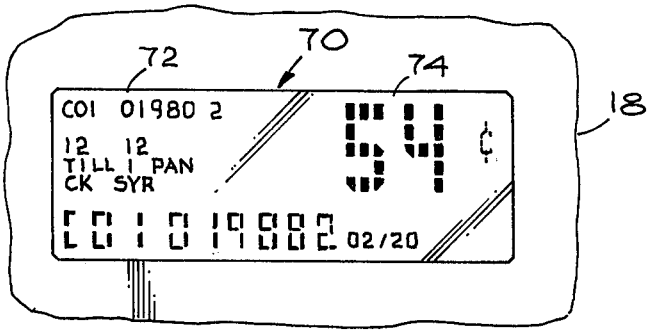
FIG. 3 is an illustration of a typical label to be printed by apparatus in accordance with the present invention.

In certain applications of an impact printer of the type illustrated in FIG. 1, it is desirable to produce labels or other documents containing different size type. For example, in one interesting application for supermarket usage, it is desirable to produce a label 70 (FIG. 3) containing product identification information 72 in standard size type and price information 74 in much larger type for display purposes. Labels of the kind depicted in FIG. 3 are used on supermarket shelves to display product and price information. Typically, the labels 70 are adhesively backed and removably adhered to an edge perforated paper web 18 (as in FIG. 1) which can be drawn by the tractors through the printer as aforedescribed.

In impact printers of the kind depicted in FIG. 1 in which a full standard size character is printed on each hammer impact, character size is, of course, fixed and larger than standard size characters must be modularly formed. That is, typically the face of a hammer will have a height equal to 0.180 inches a width equal to 0.100 inches. These dimensions of course define the maximum size character to be printed upon a single impact. A typical standard size character has a height and width slightly smaller than the dimensions of the hammer face; e.g. a height of 0.100 inches and a width of 0.070 inches. In order to form large characters 74, as for display purposes, the characters can be formed modularly, i.e. by printing separate blocks and orienting them relative to one another to form a large image of a character.

Figure 4A:
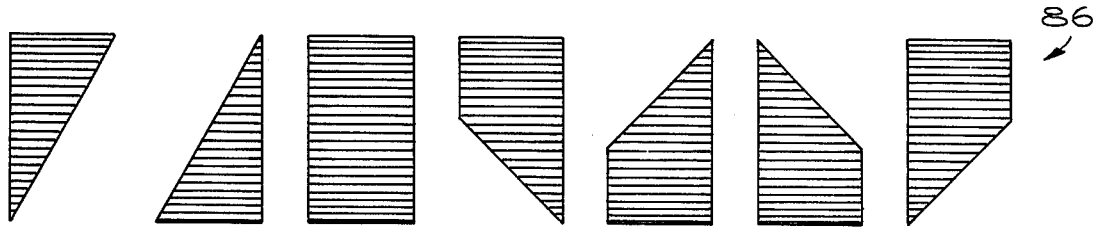
FIG. 4(*a*) illustrates typical solid blocks to be printed by apparatus in accordance with the present invention.
Figure 4B:
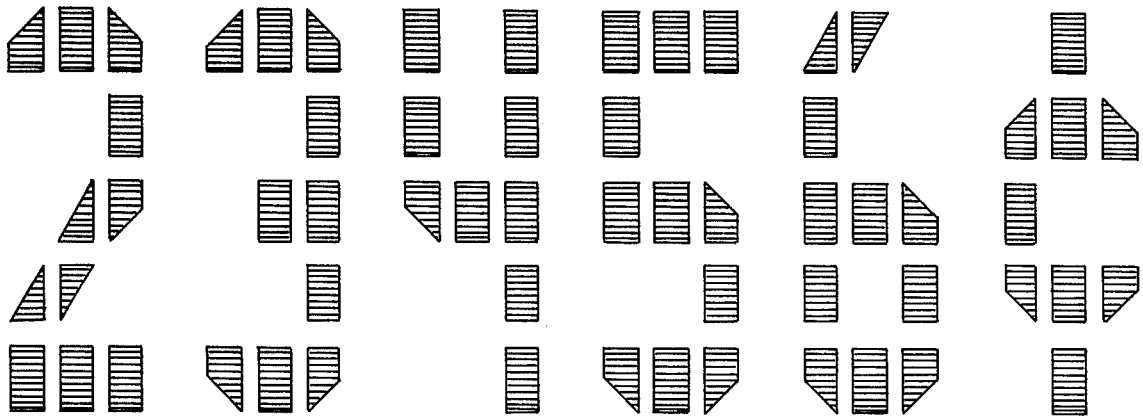

FIG. 4(*a*) illustrates seven solid block shapes which are horizontally shaded to represent solidly inked areas. The blocks of FIG. 4(*a*) can be utilized in conjunction with one another in a matrix format to form various large numeric characters as shown in FIG. 4(*b*). Each of the seven characters shown in FIG. 4(*a*) can, of course, be formed on the movable type surface as can any standard size alphanumeric character. The problem, however, encountered in utilizing solid block characters, as represented in FIG. 4(*a*), formed on the type surface has been that they produce only low density or very light print.

More particularly, inasmuch as each impacting hammer normally impacts with the same force regardless of the particular character being impacted, the printing density, or degree of print darkness, is inverse to the amount of character land area. That is, a constant force delivered by a hammer against a low land area character such as "." will produce a darker mark than a higher land area character such as "W." In recognition of the variations in print density attributable to varying land areas, it is typical to design character fonts to achieve a fair degree of uniformity of land areas amongst all the characters. However, large solid blocks of the type represented in FIG. 4(*a*) have required considerably larger land areas than standard characters. As a consequence, in the past, when printing documents, such as label 70 of FIG. 3, requiring both standard type and modular type, it has been extremely difficult to achieve printing of satisfactory density or darkness in the large type characters. The present invention is directed to an improved type character structure for achieving high density printing of solid block characters of the type depicted in FIG. 4(*a*).

Figure 5A:
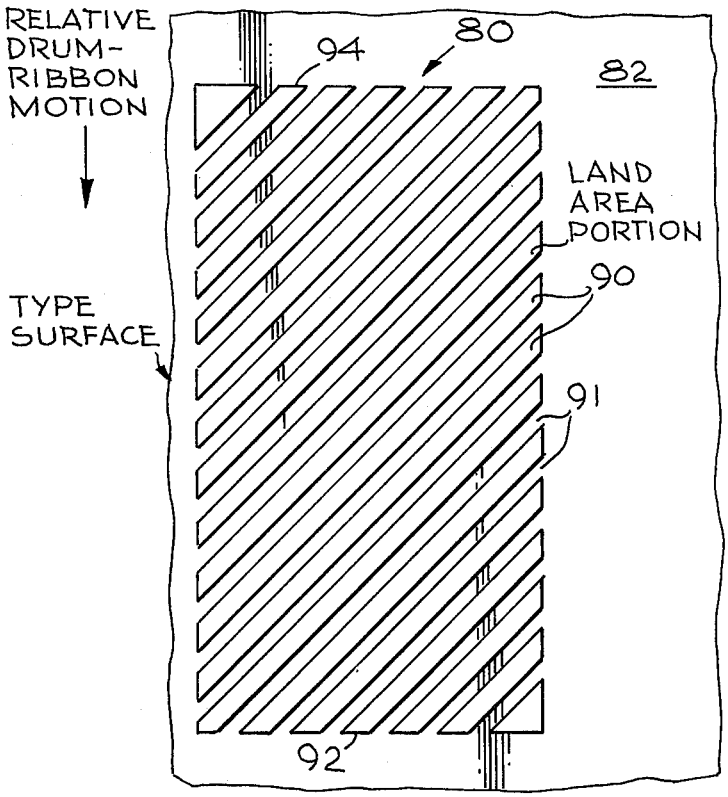
FIGS. 5(*a*) and 5(*b*) illustrate a preferred embodiment of type character constructed in accordance with the present invention.
Figure 5B:
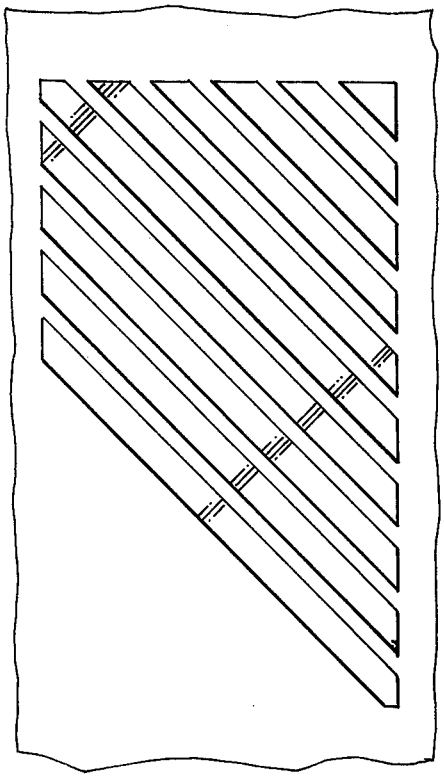

Attention is now directed to FIG. 5(*a*) which illustrates a type character structure 80 formed on the type surface 82, which may comprise, for example, either the drum 50 of FIG. 2(*a*) or the belt 54 of FIG. 2(*b*), for printing the solid block character 86 of FIG. 4(*a*). In lieu of utilizing a type character of solid land area to print the character 86, the land area is segmented into a plurality of land area portions 90 spaced by recesses 91. The effect of segmenting the land area into a plurality of spaced land area portions is to reduce the effective land area or contact area against which the hammer impacts, thereby increasing the density of the printed image. More particularly, in order to print any solid block of certain periphery, i.e. size and shape, a type character structure is formed on the type surface which is comprised of a plurality of spaced land area portions distributed in an area on the type surface having a corresponding periphery, i.e. size and shape.

In order that the plurality of separate land area portions print a solid block, the land area portions 90 must be arranged so as to take advantage of the smear produced as a consequence of the relative motion between the moving type surface and the fixed ribbon to fill in the spaces or voids between the land area portion. Thus, considering the type character structure of FIG. 5(*a*) and assuming drum movement downwardly such that edge 92 comprises the character leading edge and edge 94 comprises the character trailing edge, a line projected from the leading to the trailing edge in the direction of type surface movement must intersect considerable land area portions. The amount of smear which occurs depends of course upon the parameters of the particular impact printer and are in part determined by the speed of type surface movement, the impact duration, the characteristics of the ribbon, etc. Typically however, in the case of a drum in which the characters move vertically past the hammer faces, the thickness of a horizontal line will be increased by 0.010 inches as a consequence of smear.

In a preferred embodiment of the invention, as depicted in FIGS. 5(*a*) and 5(*b*), the land area portions 90 comprise elongated strips or segments spaced by recessed channels oriented at substantially 45° relative to the direction of type surface movement. By so orienting these land area portions, the relative motion between the type surface and ribbon essentially cleans lint and other residue from the spaces between the land area portions as the ribbon essentially wipes clean the passing type character.

From the foregoing, it should now be appreciated that applicants have herein disclosed an improved type character structure for use in impact printers for printing solid blocks of high density. High density printing is achieved in accordance with the present invention by utilizing type characters comprised of a plurality of spaced land area portions distributed in an area of the type surface having a periphery conforming to the shape and size of the block to be printed. The plurality of land area portions present a lower effective contact area to an impacting hammer than would a solid land area of the same periphery, therefore yielding higher density print. The spaces between the land area portions fill in on the printed character as a consequence of smear attributable to the relative movement between the type surface and ink ribbon.

The embodiments of the invention in which an exclusive property or privilege is claimed are defined as follows:

1. A type surface useful in an impact printer which moves type characters, from the leading to the trailing edges thereof, past a plurality of aligned hammers, each hammer being individually actuatable to impact against a selected type character to print an image of the selected character on a paper passed therebetween, said type surface including at least one type character thereon for printing a single element of a matrix character comprised of a plurality of such elements, said one type character comprising:

a plurality of land area portions each raised above said type surface;

said plurality of land area portions being spaced from one another and distributed within an area on said type surface so as to define a substantially rectangular periphery;

said plurality of land area portions being positioned within said periphery such that a line projected in the direction of type surface movement from the leading to the trailing edge of said one type character intersects multiple land area portions whereby a hammer impacting against said land area portions will print a solid block having a periphery substantially corresponding to said substantially rectangular periphery with the spaces between land area portions being filled in as a consequence of smear attributable to the relative movement between said type surface and hammer.

2. The type surface of claim 1 wherein said plurality of land area portions includes a plurality of elongated parallel segments oriented at substantially 45° relative to said direction of type surface movement.

* * * * *